United States Patent [19]

Hofmann

[11] 4,436,230

[45] Mar. 13, 1984

[54] ARRANGEMENT FOR PULSATION-FREE FEEDING OF A LIQUID MEDIUM

[75] Inventor: Frank Hofmann, Hamburg, Fed. Rep. of Germany

[73] Assignee: Firma Walter Hofmann Maschinenfabrik, Fed. Rep. of Germany

[21] Appl. No.: 238,336

[22] Filed: Feb. 26, 1981

[30] Foreign Application Priority Data

Feb. 26, 1980 [DE] Fed. Rep. of Germany ..... 3007116

[51] Int. Cl.[3] ..... F04B 21/02; F04B 23/06

[52] U.S. Cl. ..... 222/614; 222/621; 222/275; 222/278; 222/318; 239/127; 417/539

[58] Field of Search ..... 417/539, 3–5, 417/26, 27; 222/275, 278, 318, 372, 614, 615, 621; 239/127, 329, 331, 332; 137/568

[56] References Cited

U.S. PATENT DOCUMENTS

| | | | |
|---|---|---|---|
| 2,620,734 | 12/1952 | Saalfrank | 417/539 |
| 3,025,803 | 3/1962 | Swarthout | 417/539 X |
| 3,816,029 | 6/1974 | Bowen et al. | 417/539 X |
| 4,127,360 | 11/1978 | Carpenter | 417/5 |
| 4,321,014 | 3/1982 | Eburn, Jr. et al. | 417/5 |

FOREIGN PATENT DOCUMENTS

| | | | |
|---|---|---|---|
| 904655 | 7/1972 | Canada | 222/383 |
| 2300379 | 8/1973 | Fed. Rep. of Germany | 222/278 |
| 462869 | 9/1968 | Switzerland . | |
| 1068863 | 5/1967 | United Kingdom . | |
| 1357448 | 6/1974 | United Kingdom . | |
| 1360800 | 7/1974 | United Kingdom . | |
| 1450400 | 9/1976 | United Kingdom . | |

*Primary Examiner*—David A. Scherbel

*Attorney, Agent, or Firm*—Allison C. Collard; Thomas M. Galgano

[57] ABSTRACT

A device for providing pulsation-free feeding of a liquid medium from a supply container to a consuming device for use in a road-marking machine is disclosed. Two statically-operating reciprocating-piston pumps are arranged between the supply container and the consuming device such that when one pump is on suction stroke, the other is on a feed stroke. The pump flow rate is proportional to the drive speed of the road-marking machine and the feed flow of each pump has zones which overlap the other. The feed sides of the pumps are connected to a change-over means which alternately connects delivery flows from the pumps to the consuming device and also connects the pressure side of the pumps simultaneously to the consuming device and to the supply container, which prevents pressure flow fluctuations as the back-pressure to each pump is the same.

9 Claims, 3 Drawing Figures

ARRANGEMENT FOR PULSATION-FREE FEEDING OF A LIQUID MEDIUM

Figure 1A:
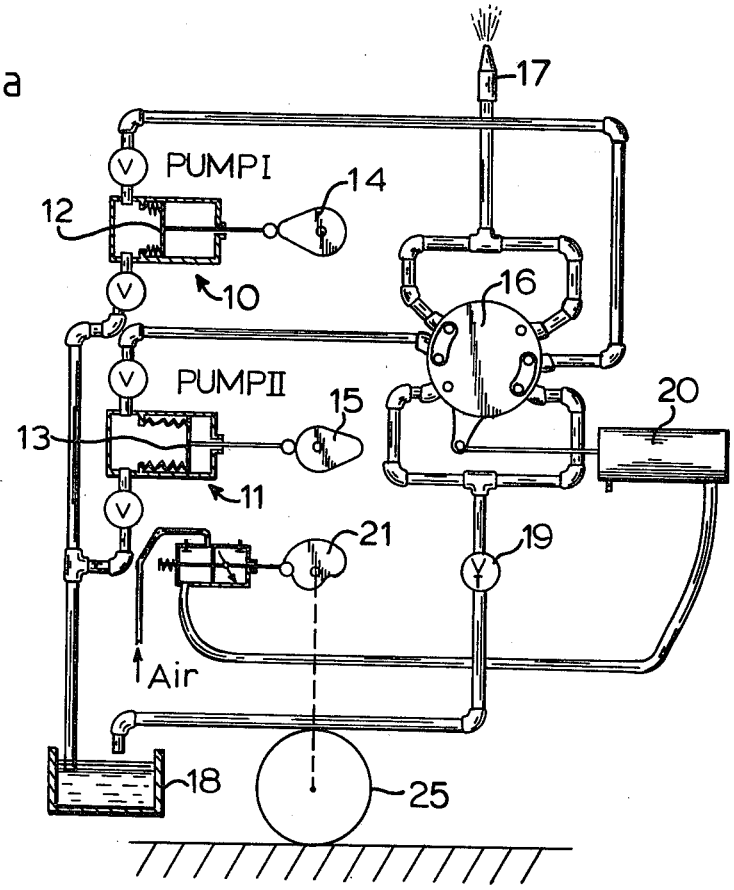

The invention relates to an arrangement for pulsation-free feeding of a liquid medium from a supply container to a consuming device by means of statically-operating feeding devices with reciprocating displacement means, as well as a road marking machine with such a device.

A number of feeding problems exist when feeding a medium by pumps, especially when the medium should be fed in a pulsation-free manner and wherein, for various reasons, rotary or centrifugal pumps cannot be used, but instead the feeding has to be carried out with displacement pumps with reciprocating displacement means, e.g., pistons. In order to prevent the constantly increasing and decreasing feeding with consequently non-steady pulsating flows in the feed lines which are caused by the unusual connecting or piston rods or the eccentric kinematics of these pumps, many measures and devices have already been proposed and carried out.

Thus, it was attempted to compensate for the pulsation of each piston at least to a substantial extent by providing phase-displaced operating pistons in the same system. However, such pumps are only successful in oil hydraulics with slide-operated pumps.

With non-lubricating or non-viscous liquids, piston pumps are predominantly used of the classical type having a suction and pressure valve for each piston. In order to eliminate the pulsation or residual pulsation with a plurality of pistons, expansion chambers are provided on the pressure side. However, since the pulsation damping effect of expansion chambers depend on the frequency (pump speed or number of strokes) and also on the prevailing pressure conditions which also constitute or serve as an elastic element on the pressure side, expansion chambers are not desirable in cases where a precise static feed or delivery is desired over a large speed and back pressure range or where the feeding flow must be abruptly stopped and again released, as is the case with road marking machines when marking interrupted traffic lines by means of paint spray guns or the like.

In order to obtain a pulsation-free, counter or back pressure-independent feeding or delivery flow with reciprocating pistons, completely different kinematics were developed in contrast to the crank drive assembly.

All kinematics which deviate from the crank drive assembly have the same object- namely, to make the sum of the speeds of all pistons which take part in the feeding constant. This principle known, per se, for some time is disadvantageous in that a true pulsation-free overlapping may only be obtained at atmospheric pressure or at very low back pressures.

For example, the precompression can be obtained in the pumping operation by appropriate kinematic variation in the pump drive, or in the case of hydraulic pump drives by means of pressure reservoirs and pressure regulating valves. All of these methods have the disadvnatage that the compensation for the working or operating pressure must be varied as a function of the operating pressure. During frequently changing operating pressures, the compensation for the operating pressure must also be adjusted which is bothersome.

It is therefore an object of the invention to eliminate the aforementioned disadvantages and, in particular, but not exclusively, to solve the problem for road marking machines and to provide a simple device with pulsation-free statically operating feeding devices with reciprocating displacment means without precompression, wherein the precompression procedure has no pulsation-enhancing influence.

This object of the invention is obtained in a device of the aforementioned type wherein the pressure side of at least two feeding devices is provided with overlapping zones of equal feeding flows, relative to the drive speed, and these feeding flows are successively and alternately connectable with the consuming device or the supply container by means of a switch-over element.

In a road marking machine with such a device the feeding devices should be pumps which are driven as a function of the drive speed of the road marking machine, whereby the feed flows are proportional to the travelling or drive speed. For obtaining the zones of the feed flows which are proportional to the drive speed, the displacement means of the pumps are coupled with the drive of the road marker machine by means of plate cams having areas of uniform gradient or slope, or they may be coupled with the drive by a rack and pinion gear assembly, or via hydraulic cylinders which are driven by liquid pumps which are coupled with the drive of the road marking machine. Naturally, other suitable drives of known types may be used. In order to be able to operate with relatively high feeding pressures, the drive of the displacement means may be carried out by means of a pressure fluid which contacts the displacement means directly.

The pumps are preferably bellows or diaphragm pumps, especially when abrasive material is fed. However, other pumps with oscillation operating displacement means may be used.

In a preferred embodiment of the invention, a throttle member is provided in the return line to the supply container, the resistance of which is adjustable to the resistance of the consuming device.

The switch-over or change-over means should be designed in such a manner that during the switch-over process the pressure sides of the pumps are simultaneously coupled with the consuming device and the supply container. The actuation of the switch-over means occurs during the pressure or feed stroke of both displacement means in the zone of the overlapping feeding of the displacement means in proportional dependency to the drive speed of the road marking machine. Preferably, the actuation of the switch-over means is derived from the drive of the displacement means. Advantageously, a pneumatically or hydraulically actuated piston may be used for actuation.

The pumps as well as the switch-over means should be heatable by a heat carrier medium, especially for very viscous materials.

Figure 1B:
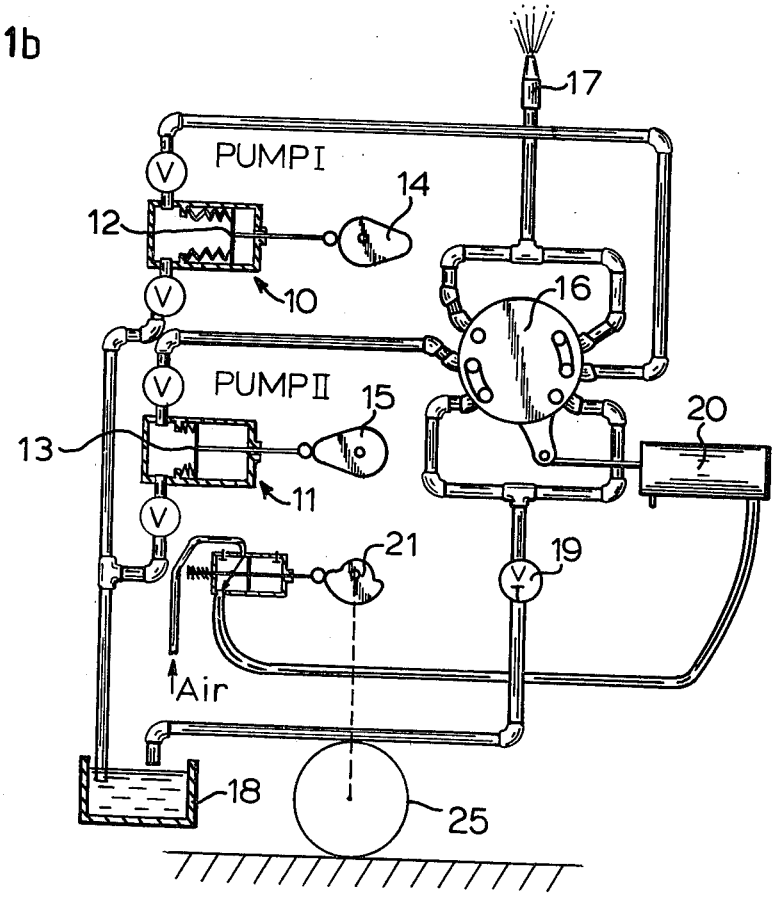
Figure 2:
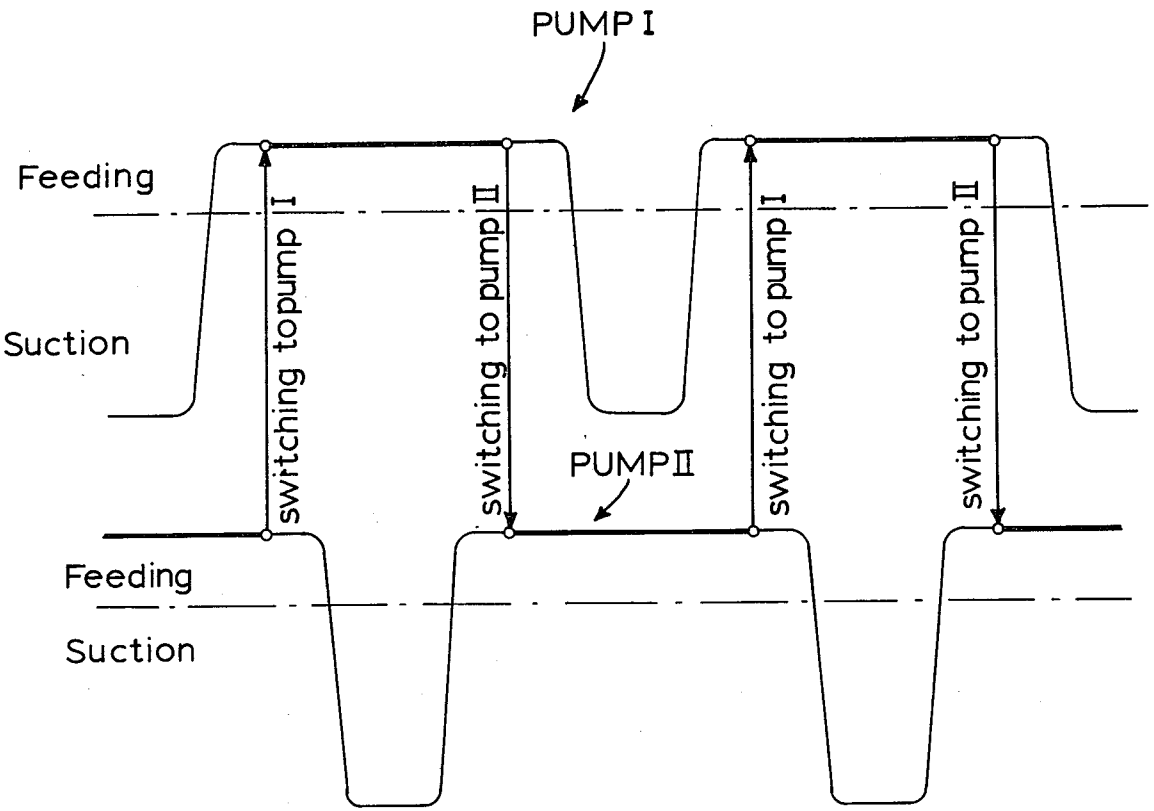

The invention will now be shown in conjunction with the appended drawings in which:

FIG. 1*a* and 1*b* show the arrangement of the piston pumps of the inventive road marking device with two different operating positions of the pumps, FIG. 2 shows the feed diagram of the two pumps.

The same reference numerals are used for the same parts in the drawings. In FIGS. 1*a* and 1*b*, on piston pump 10 and the other piston pump 11 are shown together with their associated pistons which, in the shown example, are bellows pistons, with which the abrasive medium is fed, and which are denoted 12 and 13. The pistons are controlled by plate cams 14 and 15. While the suction sides of the piston pumps 10 and 11 are connected with a supply container 18, the pressure sides are directed to a switch-over device 16 through which the pumps are alternately connectable to a consuming device 17, for example, the spray gun of a road marking machine or to the supply container 18.

An adjustable throttle member 19 is provided in the line to the supply container. The actuation of the swtich-over device is carried out in the shown embodiment by a pneumatic cylinder 20 which is controlled by a cam 21 which is mounted on the same axis as the control cams 14 and 15, and is thus rigidly coupled with the piston movement. Cam 21 may be driven by any suitable and conventional means via road wheel 25 as is schematically shown in FIGS. 1*a* and 1*b*.

In FIG. 2, the feeding diagrams of the two piston pumps I and II are shown. As can be seen, due to the inventive embodiment of forming the control cams 14 and 15 with overlapping zones or areas of constant slopes or gradients and the arrangement of the switch-over means 16, a completely pulsation-free feeding flow is obtainable. Since the consuming device of the feeding medium is constantly connected with only one cylinder, the feeding medium never reaches the consuming device as a result of a sum flow from two or more cylinders. The additional feeding quantity which is present in the overlapping zone due to the simultaneous feeding of two pistons is not fed to the consuming device 17, but back to the supply container 18 through a throttle 19, the resistance of which corresponds to the resistance of the consuming device. Therefore, in the corresponding cylinder the same operating pressure builds up as in the cylinder which is coupled with the consuming device. Consequently, two equal flow streams with the same back pressures are present in the overlapping zone of the feeding strokes of the two pistons of which one is fed to the consuming device and the other of which is returned to the supply container.

In the overlapping zone of the two feed strokes the consuming device is switched over, by the switch-over deivce 16, from the piston which is shortly before the end of the feed stroke to the piston which has just started the feed stroke. Simultaneously, the return flow to the supply container is switched over from the piston which is shortly after the starting of the feed stroke to the piston which is shortly before the completion of the feed stroke, so that the residual quantity of the latter flows back into the supply container.

In order to avoid pressure and feeding flow fluctuations during the switch-over, both pistons are coupled simultaneously with the consuming device and with the return to the supply container during the switch-over process. Thereby, a pressure and feeding flow fluctuation is prevented because during this time period the two equally large feeding flows are acted upon as a total flow of double the volume of one due to the parallel connection of the individual resistances, which in accordance with the laws of hydromechanics results in the same back pressure.

Switch-over or change-over valves for such purposes may in a known manner be constructed as slide or seat valves so that pumps may be used for the aforementioned exact static pulsation-free feeding for lubricating as well as for non-lubricating abrasive solid materials.

The proposed device is suitable for all types of piston pumps with uniform piston speed. The aforementioned problem of the precompression, which in the hitherto systems resulted in pulsation if not observed carefully or if imprecisely adjusted, is not present in the subject system, because the process of the precompression may be carried out with a sufficiently large time interval before the time at which the consuming device is coupled with the already precompressing feeding cylinder with the aid of the switch-over valve. This is particularly advantageous in pump types which are relatively elastic in their structure and which cannot be constructed in a more rigid manner due to other required characteristics (for example, temperature resistant, hermetic seal), for example, bellows pumps.

A further advantage of the inventive device is that rigid but technically very cumbersome pump constructions for static and pulsation-free feeding may be replaced very often by simpler and less expensive but more elastic constructions as in the subject device wherein the problem of the interfering precompression process is eliminated.

I claim:

1. An apparatus for pulsation-free feeding of a liquid medium, operable at a certain drive speed, comprising:

a supply container for a liquid medium;

a consuming device;

at least two statically-operated feeding devices, each of which has an inlet end communicating with said supply container and a discharge end, as well as reciprocating displacement means which has a feed stroke for generating a liquid flow out of said discharge end of each feeding device, said feed strokes of said feeding devices overlapping one another and producing equivalent liquid flows; and switch-over means for successively, simultaneously, and alternately connecting said discharge ends of said feeding devices with said consuming device and with said supply container, respectively, during said feed strokes of said feeding devices.

2. The apparatus according to claim 1, wherein said feeding devices are pumps having drive means which are coupled to a drive of a marking machine so that the feeding flows of the pumps are proportional to the drive speed of said machine.

3. The apparatus according to claim 2, wherein said drive means comprises plate cams coupled to said displacement means of said pumps which have zones of uniform slopes and which are connected to said drive of the marking machine .

4. The apparatus according to claim 2, wherein said pumps are bellows pumps.

5. The apparatus according to claim 2, wherein said pumps are diaphragm pumps.

6. The apparatus according to claim 2, additionally including actuation means for said switch-over means for effecting a switch-over during the overlapping feed strokes of said displacement means which actuation means is dependent on the said drive.

7. The apparatus according to claim 6, wherein said actuation means for said switch-over means is coupled to said drive means of said displacement means.

8. The apparatus according to claim 7, wherein said actuation means includes a piston.

9. The apparatus according to claim 1, additionally including a throttle member interconnecting said switch-over means and said supply container, the resistance of which can be adjusted to the resistance of the consuming device.

* * * * *